United States Patent [19]

Hudson

[11] 3,935,617

[45] Feb. 3, 1976

[54] FASTENING DEVICES

[76] Inventor: Leslie Gordon Hudson, Little Copped Hall, Epping, Essex, England

[22] Filed: Aug. 13, 1974

[21] Appl. No.: 496,986

[30] Foreign Application Priority Data

Aug. 15, 1973 United Kingdom ..... 38584/73

[52] U.S. Cl. ..... 24/81 B; 52/502

[51] Int. Cl.[2] ..... A44B 21/00; E04B 5/52

[58] Field of Search ..... 24/81 B, 259 SG, 259 R, 24/73 B, 73 PC; 52/499, 500, 501, 502, 498

[56] References Cited

UNITED STATES PATENTS

| | | | |
|---|---|---|---|
| 2,219,239 | 10/1940 | Schaffert et al. | 52/498 |
| 2,341,121 | 2/1944 | Schaaff | 24/259 PF |
| 2,637,422 | 5/1953 | Bell | 52/502 |
| 2,765,397 | 10/1956 | Harris | 24/73 B |
| 3,697,125 | 10/1972 | Van Sickle | 24/81 B |

*Primary Examiner*—Paul R. Gilliam
*Assistant Examiner*—B. Gelak
*Attorney, Agent, or Firm*—Woodhams, Blanchard and Flynn

[57] ABSTRACT

The invention relates to a clip which can be used to releasably fasten a member such as a display panel in a frame. The clip has a configuration such that it can be mounted on the frame, and a stop for supporting the panel which is held by a resilient or flexible arm which moves towards or away from a body of the device in order to allow the panel to be mounted on or de-mounted from the frame.

3 Claims, 4 Drawing Figures

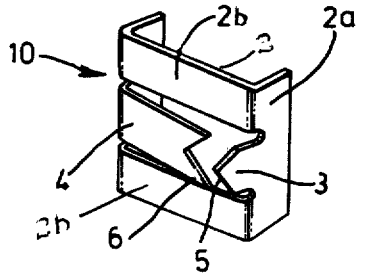
FIG. 1.
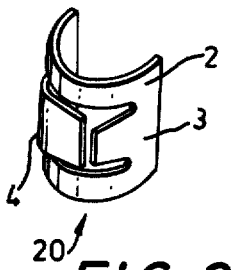
FIG. 2.
FIG. 3.
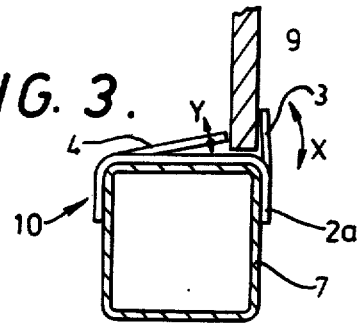
FIG. 4.
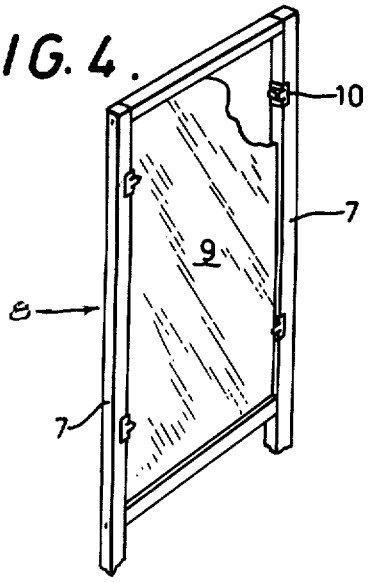

FASTENING DEVICES

The invention relates to improvements in and relating to releasable fastening devices. Such fastening devices may, for example, comprise clips or other members which can be used for fastening hardboard, plywood, cardboard, metal, plastics or other material in a frame or to make for example a display device framework.

According to a first aspect, the invention provides a releasable fastening device for supporting a member such as a display panel, comprising a body adapted to receive and support a member and a resilient or flexible abutment member adapted to be movable towards and away from the body, so that in use the member can be received by, and released from, the body.

According to a second aspect, the invention provides a releasable fastening device for supporting a member such as a display panel, comprising a body which has a first abutment member and a second abutment member disposed in spaced apart relation, the second abutment member being flexible, the arrangement being such that the second abutment member can move to and away from the body and can engage a member such as a display panel which is supported by the first abutment member and is between the first and second abutment members.

Preferably, the body may include a stop member.

Suitably, the reciprocable member may comprise tang means which can engage a surface of the panel or other member. Preferably, the reciprocable member is a spring member.

Two releasable fastening devices embodying the invention are diagrammatically illustrated, by way of example, in the accompanying drawings, in which:

FIG. 1 shows a perspective view of a first device;

FIG. 2 shows a perspective view of a second device;

FIG. 3 shows an end elevational view of the first fastening device in use; and

FIG. 4 shows a perspective view, partly cut away, of a panel held in a framework using a plurality of the devices of FIG. 1.

Referring to the drawings, in which like parts are referred to by like reference numerals the fastening device or clip 10 shown in FIG. 1 has a body or body portion 2 of channel section including an integral stop or abutment member in the form of one arm 3 upstanding therefrom, which can support a panel in use, and an integral reciprocable spring or second abutment member in the form of further arm 4. The arm 3 has a point or tang 5, while the spring arm 4 has a pair of tangs 6. The configuration of the free end of the arm 3 is complementary to that of the free end of the arm 4.

The second fastening device or clip 20, shown in FIG. 2, is similar to that of FIG. 1 except the body portion 2 is arcuate in cross section so that it can engage a round tube. Also, arms 3 and 4 do not carry tangs. In both embodiments, the arms have a gap therebetween into which a panel member can be pushed. The arm 3 can be pivoted about its junction line on the body portion in the direction of the arrow "X" in FIG. 3 to allow entry of a larger or smaller thickness of panel member.

In use, four devices 10 are suitably placed at desired locations on side members 7 of a frame 8 made for example of tubular members in a rectangular configuration. The panel 9, for example of hardboard, is then pushed into the gaps between the arms 3 and 4 of each device 10, from left to right as viewed in FIG. 3, over the further arm 4.

The arms 4 are flexible and spring downwardly in the direction of the arrow "Y" (FIG. 3) as the panel is pushed in. When the panel is in position, the arms 4 can engage the surface of the hardboard with the tangs 6 and so hold the panel firmly against the arm 3, which acts as a stop member, which rests against the outside or front of the panel 9.

To release the panel 9, the arm 4 is pushed downwardly towards the body portion 2, so allowing the panel to be removed (leftwardly as viewed in FIG. 3).

It will be understood that the body portion 2 engages the tubular member 7 with a positive or push fit through legs **2*a*, and are easily mounted on and released from the member 7. The legs 2*a* are joined by the parallel bridging portions 2*b*, which portions are spaced apart and have the arms 3 and 4** positioned therebetween.

The fastening devices may be made from any suitable material other than metal, and may have a body portion of any configuration. The arms are suitably integral with the body portion.

It will thus be understood that a framework can be assembled, and a panel such as a display panel, can easily be mounted therein or removed. Moreover, in place of the devices 10, 20 the arms 3, 4 could form an integral part of support members 7.

I claim:

1. A releasable fastening device for supporting a member, such as a display panel, comprising body means which has seating means defined by first and second arm means each of which protrudes from the body means, said arm means being directed away from said body means towards one another and terminating spaced from one another thereby defining therebetween a gap in which said display panel can be received, said first arm means defining a lateral stop for said display panel and said second arm means being resiliently mounted on said body means whereby said second arm means can move towards and away from said body means so that when a display panel enters said gap said second arm means can engage said display panel and whereby said display panel can be released by resiliently urging said second arm means towards said body means so that the said second arm means is disengaged from said panel, said body means being of a generally channel-shaped cross section and including a pair of end portions and a center portion which extends between and integrally connects said end portions, said center portion being defined by a pair of substantially parallel striplike bridging portions which extend between the end portions and are disposed adjacent the opposite edges of said body means, said center portion having a space located between said bridging portions said first arm means being integrally connected to one of said end portions and projecting outwardly from said bridging portions said second arm means being integrally connected to the other of said end portions and projecting outwardly from said bridging portions, said first and second arm means projecting generally toward one another and being substantially aligned with the space between said bridging portions.

2. A device according to claim 1, wherein said first arm means is a relatively short first cantilevered arm which projects outwardly from said bridging portions adjacent one end of said space, and wherein said second arm means is a second cantilevered arm which is substantially longer than said first arm and projects outwardly at a small angle relative to said bridging portions, said second arm means being connected to said body means adjacent the other end of said space and having a length extending over a major portion of the length of said bridging portions.

3. A device according to claim 1, wherein each of said first and second arm means are resiliently flexible.

* * * * *